United States Patent [19]

Paynter

[11] Patent Number: 4,721,030

[45] Date of Patent: Jan. 26, 1988

[54] HYPERBOLOID OF REVOLUTION FLUID-DRIVEN TENSION ACTUATORS AND METHOD OF MAKING

[76] Inventor: Henry M. Paynter, 35 Scotland Rd., Reading, Mass. 01867

[21] Appl. No.: 755,605

[22] Filed: Jul. 16, 1985

[51] Int. Cl.[4] ..... F01B 19/04

[52] U.S. Cl. ..... 92/92

[58] Field of Search ..... 92/90, 91, 92, 48, 89

[56] References Cited

U.S. PATENT DOCUMENTS

| | | | |
|---|---|---|---|
| 2,642,091 | 6/1953 | Morin | 92/90 |
| 2,789,580 | 4/1957 | Woods | 92/90 |
| 2,844,126 | 7/1958 | Gaylord | 92/90 |
| 3,066,853 | 12/1962 | Landenberger | 92/90 |
| 3,579,412 | 5/1971 | Paine | 92/92 |
| 3,645,173 | 2/1972 | Yarlott | 92/47 |
| 4,108,050 | 8/1978 | Paynter | 92/92 |
| 4,189,985 | 2/1980 | Harris | 92/153 |

*Primary Examiner*—Abraham Hershkovitz
*Attorney, Agent, or Firm*—Parmelee, Bollinger & Bramblett

[57] ABSTRACT

A fluid-driven tension actuator has a pair of end-connection, ring-shaped fittings of relatively large internal diameter with multiple inextensible strands anchored to them and initially extending between them as straight lines oriented at a pitch angle in the range from 60° to 120° forming a network of tension elements constraining the actuator shell and connecting together said two end fittings. These tension element strands define a ruled surface having the shape of an hyperboloid of revolution when the actuator is in its initially deflated (elongated or extended) position. These tension element strands serve to constrain the resilient, flexible, stretchable, elastomeric shell of the actuator which stretches and bulges outwardly into nearly a spherical surface of revolution when the actuator is in its inflated (contracted or retracted) position. By virtue of the relatively large internal diameter of the two end fittings there is provided at least one unrestricted port through which fluid can readily pass for efficient operation at a high cyclic rate of operation. In one embodiment, there is a single central crossing point of the respective strand elements and this crossing point stabilizes the strands during cyclic inflation and deflation of the tension actuator.

19 Claims, 19 Drawing Figures

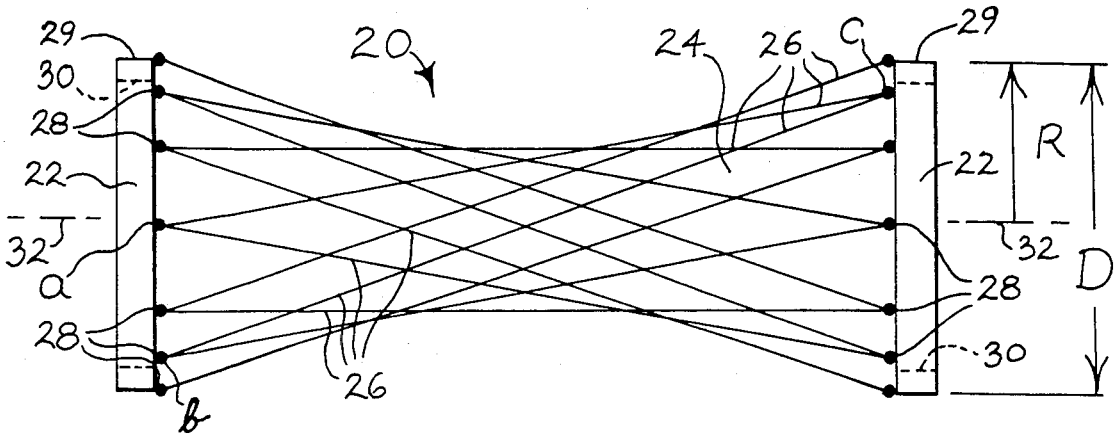
Fig. 1: Hyperboloid of Revolution as a Ruled Surface (Pitch Angle of 120° shown)
FIG. 2A
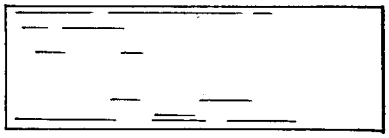
Pitch Angle: 0°
FIG. 2B
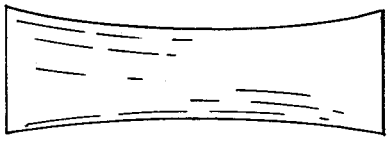
Pitch Angle: 90°
FIG. 2C
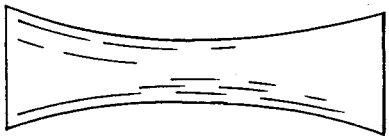
Pitch Angle: 120°
FIG. 2D
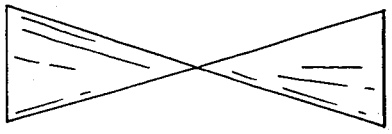
Pitch Angle: 180°
Effect of Pitch Angle

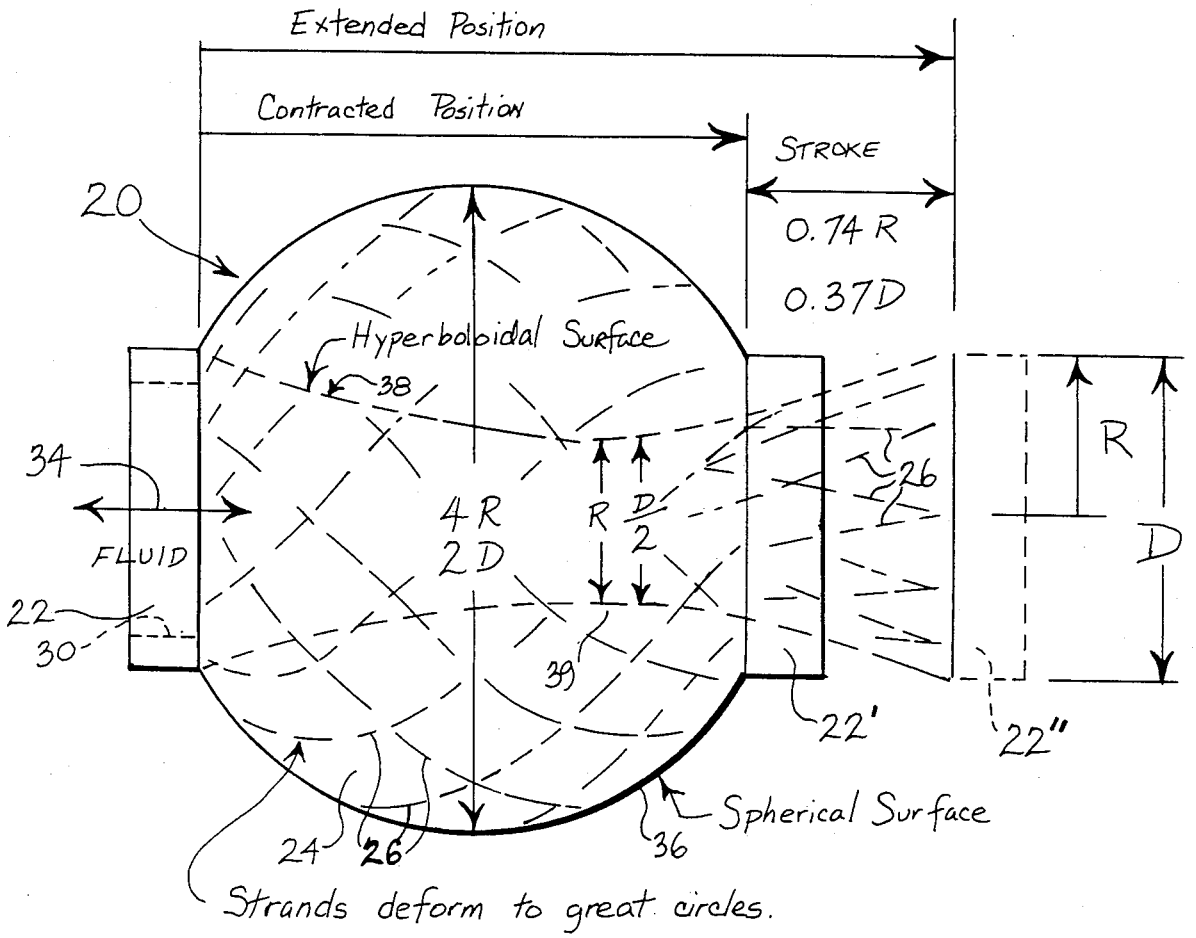
EXTENDED: Shell: Hyperboloid; Strands: Linear
CONTRACTED: Shell: Sphere; Strands: Circular Arcs
Fig. 3: Stroke Action

ACTUAL SIZE
STROKE

20A
L
D

HYPERBOLOID OF REVOLUTION FLUID-DRIVEN TENSION ACTUATORS AND METHOD OF MAKING

FIELD OF THE INVENTION

This invention relates to fluid-driven tension actuators and the method for constructing such actuators. Tension actuators convert fluid pressure energy input, for example, such as compressed air energy or the energy of pressurized hydraulic liquid, into mechanical displacement. More specifically, tension actuators convert fluid pressure energy into linear contraction displacement.

BACKGROUND

The concept of a tension actuator which contracts along its longitudinal axis when inflated is known. Such an actuator, which responds at relatively low fluid pressure, is disclosed in U.S. Pat. No. 3,645,173—Yarlott. The disclosure of Yarlott specifies a number of parameters which are markedly different from or contrary to the present invention as will be pointed out in or will become understood from the specification considered in conjunction with the accompanying drawings. In Yarlott's tension actuator:

(A) The surface area of the shell remains substantially constant in all of the various positions of the actuator. A two-way network of relatively inextensible strands,—(i) extending axially, and (ii) helically wound causes the reinforced shell to "resist elastic expansion". In other words, this reinforcing network in Yarlott's actuator is attempting to maintain substantially constant surface area in all deformed positions. However, the elastomeric shell wall must necessarily undergo a shearing deformation as the actuator is inflated for causing it to contract. This shearing of the elastomeric shell wall causes a basic incompatibility at the junction where the shell wall is attached to the rigid cylindrical coupling members at each end. Because of this shearing of the shell wall, the cylindrical end members must be of small diameter in the Yarlott actuator in order to minimize the basic incompatibility, which restricts the fluid flow through them and thus inherently slows the cycle time, i.e. causes a slow response to changes in pressure. If an attempt is made to enlarge the diameter of these cylindrical end members, in order to speed up the response time, then the basic shear versus non-shear incompatibility at the shell-to-end-member junction is accentuated leading to large localized stresses and early failure of the shell wall at this junction.

(B) The Yarlott tension actuator is particularly adapted for low pressure applications, for example, pressures in the nature of 0.25 p.s.i. gauge up to a practical limit of about 15 p.s.i. gauge; that is, up to a limit of about one atmosphere of pressure difference between internal fluid pressure and ambient pressure.

(C) The Yarlott tension actuator has extreme sensitivity to internal fluid pressure exceeding 15 p.s.i. gauge, because above that limit the elastic shell begins to expand unduly by locally bulging between the axial and helical strands, but no further axial contraction actually occurs, leading to rapid fatigue failure and likelihood of bursting when cyclically operated for more than a relatively few cycles with repeated internal pressure excursions much above 15 p.s.i. gauge. In summary, the kind of tension actuator as invented by Yarlott within its normal limited low pressure range produces a minimum of stretch of its elastic shell with a maximum of bending and flexing of the shell and considerable shear deformation of the shell near its end member connections. On the other hand, single-crossing hyperboloidal tension actuators embodying the present invention are the opposite. They do intentionally involve considerable shell stretch, and they are able to operate for hundreds of thousands of cycles with each cycle involving a pressure excursion from about 0 p.s.i. gauge up to about 30 p.s.i. gauge and back to about 0 p.s.i. gauge without any apparent significant fatigue effects.

Another device which axially contracts upon inflation is disclosed in U.S. Pat. No. 2,642,091—Morin. However, the Morin diaphragm suffers from the problem that in its neutral (deflated) state it has the geometrical configuration of a right circular cylinder, more commonly called a cylindrical surface of revolution, with inextensible threads each placed along a generating line (axially extending straight line) or each along a helix with constant pitch. Consequently, a very large increase in internal fluid pressure is needed to be applied within the Morin actuator before its reinforced hose-like wall begins to bulge for causing axial contraction.

Furthermore, if the helical threads have a pitch of 52°, and if the Morin actuator is sufficiently long that these threads make at least one complete turn (at least one complete convolution) from end to end of this cylinder of revolution, then mathematical analysis shows that no effective axial contraction will take place regardless of how high is raised the pressure of the internal fluid. In other words, even if the internal pressure in such a hose is raised to the bursting point, no significant axial contraction will occur. In summary, the Morin structure makes inefficient use of materials and causes relatively large internal stresses and strains without producing a proportional contraction in its axial length. In contrast, a tension actuator constructed in accordance with the present invention produces a much longer and more forceful contraction (longer and more forceful stroke) with the same materials and the same changes in internal fluid pressure.

U.S. Pat. No. 3,638,536—Kleinwachter et al discloses diaphragm devices for transforming a fluid pressure into torsional movement or into axial movement upon inflation. The diaphragm is elastically stretchable in preferably only one direction.

U.S. Pat. No. 2,789,580—Woods discloses a two-component mechanical transducer with an expansible cavity formed by a flexible seal having a cylindrical braided or woven metal sheath encompassing it. There is the undesirable complexity of an outer cylindrical braided sheath and a separate internal pressurizing means. An actuator embodying the present invention is a substantial simplification over the Woods' device, by virtue of being a one-component structure as distinguished from Woods' two-component structure.

U.S. Pat. No. 2,865,419—Cunningham has been reviewed by the present inventor and is considered even more remote from the present invention than the above-listed disclosures. The Cunningham structure exploits the neutral helical braid pitch of approximately 52° (as discussed above in connection with Morin's disclosure) in order to yield a dimensionally stable structure, i.e. a structure which will neither expand nor contract nor change radius upon changes of pressure in the internal fluid. This Cunningham reference is set forth as being known to the inventor in order for this discussion of known disclosures to be complete and in the event the reader might consider it to be of interest. This Cunningham patent does support the earlier explanation that a hose-like structure reinforced with two-way helical strands at a pitch of 52° and each extending for at least one full convolution is dimensionally stable; therefore, such structure has exactly the opposite characteristics from the desired long and strong stroke, fast-response axial contraction characteristics needed in high efficiency tension actuators as provided by the present invention.

SUMMARY OF THE DISCLOSURE

A tension actuator has a pair of end-connection, ring-shaped fittings of relatively large internal diameter, thereby providing a large capability for rapid fluid flow inflation and deflation of the actuator for enabling fast response, i.e. short cycle times. Multiple relatively inextensible strands are anchored to these end fittings and initially extend between them as straight lines oriented at a pitch angle in the range from 60° to 120° forming a network of tension elements constraining the actuator shell and connecting together said two end fittings.

These tension element strands define a ruled surface having the shape of an hyperboloid of revolution when the actuator is in its initially deflated (elongated or extended) position. These strands serve to constrain a resilient, flexible, stretchable, tubular, elastomeric shell of the actuator which extends between the end fittings and is secured to both end fittings in air-tight relationship. This elastomeric shell stretches and bulges outwardly into nearly a spherical surface of revolution when the actuator is in its inflated (contracted or retracted) position, thereby causing the tension strands to bow outwardly away from the axis pulling the two end fittings towards each other for providing axial contraction displacement. By virtue of the relatively large internal diameter of the two end fittings there is provided at least one relatively unrestricted port through which fluid can readily pass for rapidly inflating and deflating the elastomeric shell for efficient operation of this tension actuator at a high cyclic rate of operation.

In one embodiment, there is a single central crossing point for each of the respective tension strands, and this crossing point stabilizes the strands during cyclic inflation and deflation of the tension actuator. One such single-crossing point tension actuator is described having five strands oriented at a left-sense 72° pitch angle and five other strands oriented at a right-sense 72° pitch angle, thereby forming a total of five such crossing points. Another such single-crossing point tension actuator is described as having four strands oriented at a left-sense 90° pitch angle and four others at a right-sense 90° pitch angle, thereby forming four such crossing points.

In accordance with the present invention in one of its aspects there is provided a fluid-driven, tension actuator axially contractible upon inflation by fluid under pressure for converting fluid pressure energy into axial contraction displacement, comprising: a pair of axially aligned and axially spaced ring-shaped end fittings, a tubular resilient, flexible, stretchable, elastomeric shell extending between said end fittings and being secured in air-tight relationship to both of said end fittings, a multiplicity of relatively inextensible, flexible strands extending between said end fittings and each being effectively anchored to both of said end fittings. These strands may be bonded to the exterior surface of said tubular shell, with a first plurality of said strands extending as straight lines and each being oriented at the same first pitch angle when the end fittings of the actuator are at their maximum axial displacement from each other, and with a second plurality of said strands extending as straight lines and each being oriented at the same second pitch angle when the end fittings of the actuator are at said maximum axial displacement from each other. The first and second pitch angles have the same absolute value, but the second pitch angles are of the opposite sense from said first pitch angles. The absolute value of said first and second pitch angles are in the range from 60° to 120°, said strands all being straight lines when the end fittings of the actuator are at their maximum axial displacement from each other and each lying along a respective straight line generator element of an hyperboloid of revolution bounded at its opposite ends by said end fittings. At least one of said end fittings provides a passage therethrough communicating with the interior of said elastomeric shell for enabling said shell to be inflated and deflated, and said elastomeric shell upon inflation with fluid under pressure stretches into a generally spherical surface of revolution with said strands each bowing outwardly away from the axis approximating arcs of a great circle pulling said end fittings toward each other for producing axial contraction of the actuator.

As used herein, the term "cycle of operation" or "cycle" means an inflation plus a deflation (or conversely means a deflation plus an inflation) such that at the completion of the cycle, the tension actuator has returned to the same state as at the initiation of the cycle.

BRIEF DESCRIPTION OF THE DRAWINGS

The invention, together with further objects, features, aspects and advantages thereof will be more fully understood from a consideration of the following description taken in conjunction with the accompanying drawings in which like elements are designated with the same reference numerals throughout the various views. Also, the various elements are not necessarily illustrated to scale in order to enhance understanding and more clearly show and describe the invention.

FIG. 1 is a side elevational view of a fluid-driven tension actuator in the form of an hyperboloid of revolution as a ruled surface, with a pitch angle of 120° and with the straight line elements thereof pitch in both senses (left-sense and right-sense).

FIGS. 2A, 2B, 2C and 2D are a series of diagrammatic side elevational views showing the effect of changes in pitch angle.

FIG. 3 is a side elevational view of a tension actuator generally similar to that shown in FIG. 1 and illustrating both the Extended and Contracted Positions of a tension actuator embodying the present invention for comparing their relationships in a single view.

FIG. 6A shows this actuator fully inflated in its axially contracted state, and FIG. 6B shows it fully deflated in its axially extended state, with the resultant stroke length being indicated.

In FIG. 13 the tension strands are arranged as isosceles triangles. Two of the strands are half-looped around each other at the vertex of a pair of such triangles, providing a mid-length connection as a form of mid-length crossing point.

DETAILED DESCRIPTION

Figures 4, 5, 6A, 6B:
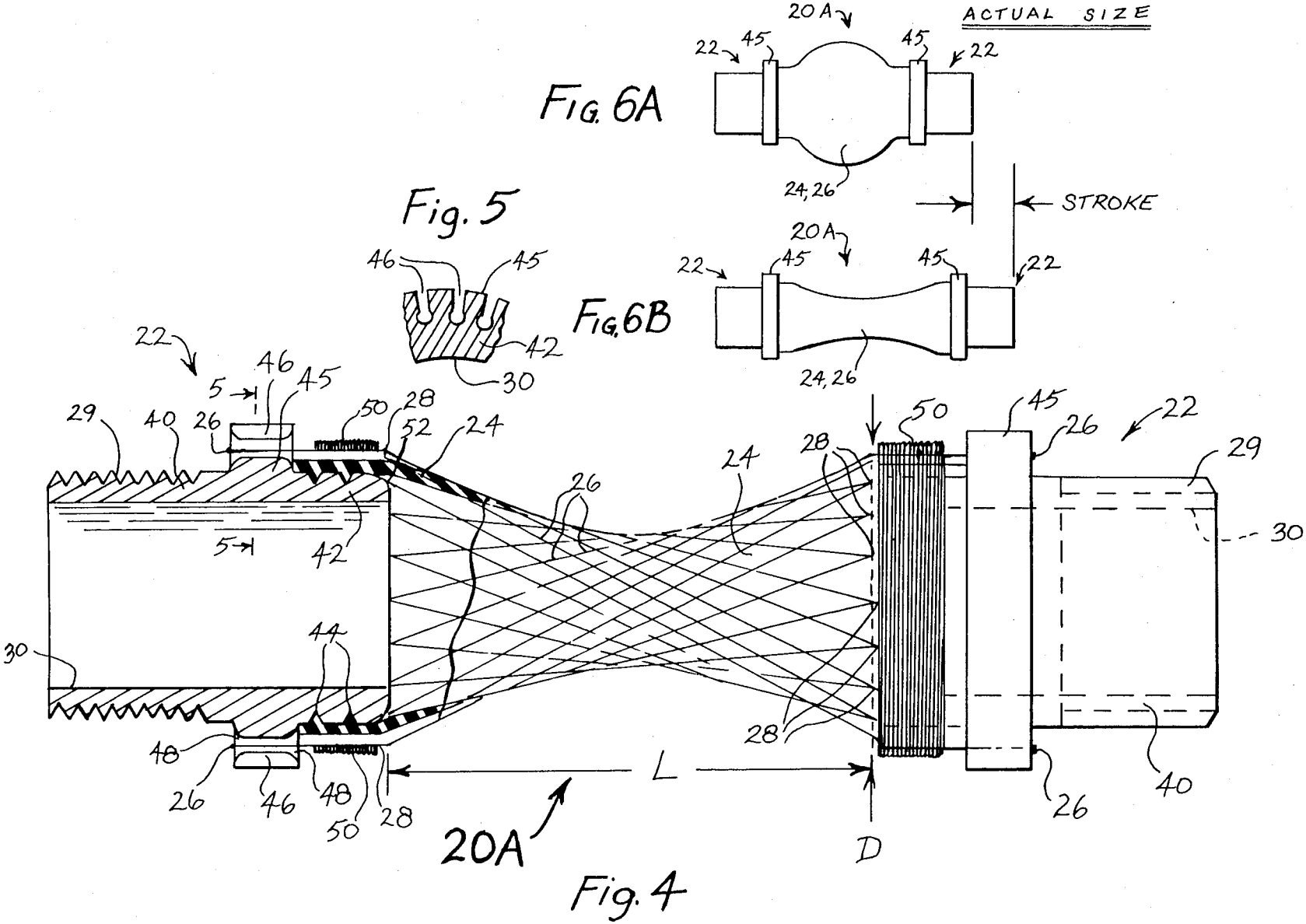
FIG. 4 is an enlarged side elevational view of another fluid-driven tension actuator embodying the invention. This view is enlarged to four times actual size, and the left end fitting and an adjacent portion of the tubular elastomeric shell are shown in section for illustrating features of construction.
FIG. 5 is a partial sectional view taken along the line 5—5 in FIG. 4 showing a portion of the slotted strand-mounting ring.
FIGS. 6A and 6B show the actuator of FIGS. 4 and 5 at actual size.

In FIG. 1 the fluid-driven tension actuator 20 is shown in its deflated (axially elongated or axially extended) state. This actuator 20 has a pair of rigid, ring-shaped end fittings 22 which are axially aligned and axially spaced. It is to be noted that these end fittings 22 each have a relatively large diameter D and a relatively large radius R compared to the overall size of this actuator 20. A tubular, resilient flexible, stretchable, elastomeric shell 24 extends between these end fittings and is secured to them both in air-tight relationship, for example, by bonding or by wrapping a serving tightly around each end of this shell, as will be explained further below. A multiplicity of relatively inextensible, flexible strands 26 extend as tension elements between the end fittings 22, being secured at anchoring points 28 to the respective end fittings. The anchoring points 28 are located at uniformly spaced positions around the circumference of the respective end fittings 22. There are the same number of these anchoring points 28 on each end fitting, and the actuator 20 is symmetrical end-to-end.

The term "strand" is intended to include an elongated, flexible tension element made from a desired material, for example such as a fiber, and which is strong, resiliently flexible and relatively inextensible. Thus, for example, a "strand" may mean a cord, string, filament, monofilament, line, a metal wire (for example of spring alloy), and having a high flexing fatigue resistance. Suitable plastic material for fabricating such a strand is "Dacron" polyester or "Kevlar" polymer.

The tubular shell 24 is made of a suitably resilient, flexible, stretchable elastomeric material, for example, such as neoprene rubber or polyurethane. The interior of this hollow shell 24 provides a chamber which is air-tight and inflatable with a suitable fluid under pressure, for example such as compressed air or hydraulic liquid.

The rigid end fittings 22 are made of a strong, lightweight material, for example such as aluminum, polycarbonate, "Debrin" acetal resin, nylon, or high density polypropylene. Each of these end fittings includes attachment or fastening means 29, for example as will be explained later with reference to FIG. 4, for connecting the fittings 22 to associated members forming parts of a machine or system to be driven by this actuator. Each of these fittings has a large diameter axial fluid passageway 30 communicating with the fluid chamber within the interior of the tubular elastomeric shell 24.

In this actuator 20, as shown in FIG. 1, there are twelve pairs of the tension element strands 26 all having a pitch angle of 120°. One of the strands in each pair is pitched in a left-sense, and the other strand is pitched in a right-sense. In other words, starting at one of the points 28 where a pair of the strands 26 are anchored, for example starting at point "a" and looking in an axial direction toward the other end of the actuator, it will be seen that one of the pair of the strands which is anchored at point "a" is sloping toward the left of the line of view and the other is sloping toward the right of the line of view.

These tension element strands 26 extend as straight lines in FIG. 1 defining a hyperboloid of revolution as a ruled surface. The axis 32 of revolution of the hyperboloid surface defined by the straight strands 26 is the longitudinal central axis of the actuator 20. These twenty-four strands 26 lie adjacent to the outer surface of the tubular shell 24. It is to be understood that none of these straight strands 26 is parallel with the axis 32 and that the actuator 20 is in its deflated axially extended position.

The meaning of "pitch angle" or "angle of pitch" will now be explained. The "pitch angle" is the angular difference with respect to the axis 32 between the positions of the two ends of one of the straight line elements 26. For example, starting at point "b" and proceeding along a straight line 26 to the point "c" will produce a change in angular position of 120° with respect to the axis 32. In other words, going from "b" to "c" will result in going one-third of the way around the axis 32, and one-third of 360° equals 120°.

The effect of changes in pitch angle is illustrated by comparing the four FIGS. 2A–D. When the pitch angle is reduced to zero, the hyperboloidal surface entirely disappears. The surface has been changed into a right circular cylinder, more commonly called a cylindrical surface of revolution. With a pitch angle of 90°, as shown in FIG. 2B, the hyperboloid surface has a gentle saddle shape. With a pitch angle of 120°, as shown in FIG. 2C, a deeper saddle shape is formed. When the pitch angle is increased to 180°, the hyperboloid surface again entirely disappears. The surface has now been changed into two conical surfaces axially aligned and touching tip-to-tip. In accordance with the present invention the pitch angle of the hyperboloid surface defined by the straight-line tension elements when the tension actuator is in its fully extended position lies within the range from 60° to 120°.

Inviting attention to FIG. 3, it will be seen that when the chamber within the elastomeric shell 24 is fully inflated with fluid 34, for example compressed air, supplied through the passageway or port 30 from a suitable source (not shown) of controllable pressure connected to the end fitting 22 at the left in FIG. 3, then the actuator 20 contracts in an axial direction. It is to be understood that the end fitting 22 at the right is connected to part of a machine or system (not shown) being driven by the actuator, and thus the fluid passageway in this end fitting is effectively plugged for preventing loss of the fluid 34 which is inflating the actuator. The fully extended position of this end fitting at the right is shown in dashed outline at 22'', and its fully retracted position is shown in full lines at 22'.

The elastomeric shell 24 stretches at full inflation to approximately a spherical surface 36 having a diameter of about 2D, where D is the diameter of an end fitting 22. The straight-line strands 26 deform into the shape of great circles of the spherical surface 36. The full stroke is 0.37D.

It is noted that in the fully extended position of this actuator 20 the hyperboloidal surface 38 has a central narrowed waist region 39 with a diameter of D/2.

FIGS. 4, 5, 6A and 6B show one practical way to construct a fluid-driven tension actuator 20A embodying the present invention. This actuator 20A is similar to the actuator 20 of FIGS. 1–3, except that this actuator 20A has twenty pairs of tension element strands 26 each at a pitch angle of 120°. The end fittings 22, for example of aluminum, include fastening or attachment means 29 in the form of pipe threads, for example with an outside diameter (O.D.) of one-half inch and a pitch of twenty threads per inch located on an axially extending outwardly projecting cylindrical end section 40 of the ring-shaped fitting 22. An end of the tubular elastomeric shell 24 is telescoped over an axially extending inwardly projecting cylindrical section 42 of the fitting 22, and this latter section includes two circumferential grooves 44 for making an air-tight seal with the shell 24 as will be explained later.

Between the two cylindrical sections 40 and 42 each end fitting 22 includes an annular ring-like shoulder 45 having twenty uniformly spaced keyhole-shaped slots 46 in its periphery as seen more clearly in FIG. 5. The tension strands 26 are formed by lacing one continuous strand back and forth for producing an effective pitch angle of 120° by passing this one continuous strand through preselected slots 46 in the respective rings 45. In order to protect the strands 26 against abrasion in their mounting slots 46, the enlarged lower end of each slot is fully rounded on both sides of the ring 45 for providing bell mouth configurations as indicated at 48 in FIG. 4. After all of the tension strands 26 have been laced into place, they and the underlying end of the tubular shell 24 are secured in place by tightly wrapping with several adjacent turns of a wound serving 50 positioned directly over the grooves 44. This tight wrapping 50 produces an air-tight connection between the shell 24 and the grooved inner section 42 of the end fitting 22. In order to avoid abrasion of the tubular shell 24, the exterior surface of this inner section 42 is rounded on its inner end at 52 where the tubular shell passes over it. The fluid passageway 30 has a clear bore with a diameter of 0.375 of an inch. The active length "L" between the inner ends of the inner sections 42 of the respective end fittings is one inch, when the actuator is fully extended as shown in FIGS. 4 and 6B, and the overall extended length between the extreme outer ends of the end fittings is 2.375 inches. After the wrapping 50 has been applied, the respective anchoring points 28 for the strands 26 are located at the inner edge of each of these wrappings.

FIGS. 6A and 6B show this actuator 20A in its actual size. FIG. 6A shows it in the axially contracted position when fully inflated, and FIG. 6B shows it in the axially extended position when fully deflated. The resultant stroke length is seen by comparing FIGS. 6A and B.

This actuator 20A was inflated with compressed air at controlled pressures and its stroke and the generated axial contraction forces under the various conditions were measured as follows:

EXAMPLE I: AT ZERO STROKE POSITION, AT VARIOUS PRESSURES

| PRESSURE: P.S.I. | FORCE: POUNDS | STROKE POSITION: IN INCHES |
|---|---|---|
| 5 | 29 | 0.0 |
| 10 | 51 | 0.00 |
| 15 | 69.5 | 0.00 |
| 20 | 85 | 0.00 |
| 25 | 100.5 | 0.00 |
| 30 | 114.5 | −0.0002 |

EXAMPLE II: AT VARIOUS STROKE POSITIONS, ALL AT 30 P.S.I.

| PRESSURE P.S.I. | FORCE: POUNDS | STROKE POSITION: IN INCHES | EFFECTIVE AREA: IN SQ. INS. |
|---|---|---|---|
| 30 | 117.5 | −0.0009 | 3.94 |
| 30 | 79 | −0.050 | 2.63 |
| 30 | 53.5 | 0.100 | 1.78 |
| 30 | 33.5 | 0.150 | 1.12 |
| 30 | 16.5 | 0.200 | 0.55 |
| 30 | 4.0 | 0.245 | 0.13 |

The effective area at any given stroke position (stroke contraction) as listed in Example II is called "A(x)" and is calculated in accordance with the following formula:

$$\text{Force} = \text{Pressure} \cdot \text{Area} \quad (1)$$

$$F(x) = \text{Measured Gauge Pressure} \cdot A(x) \quad (2)$$

$$\therefore A(x) = \frac{F(x)}{\text{Measured Pressure (gauge pressure)}} = \frac{F(x)}{30} \quad (3)$$

where "F(x)" is the measured force which is generated by the tension actuator at each given stroke position.

Figure 7:
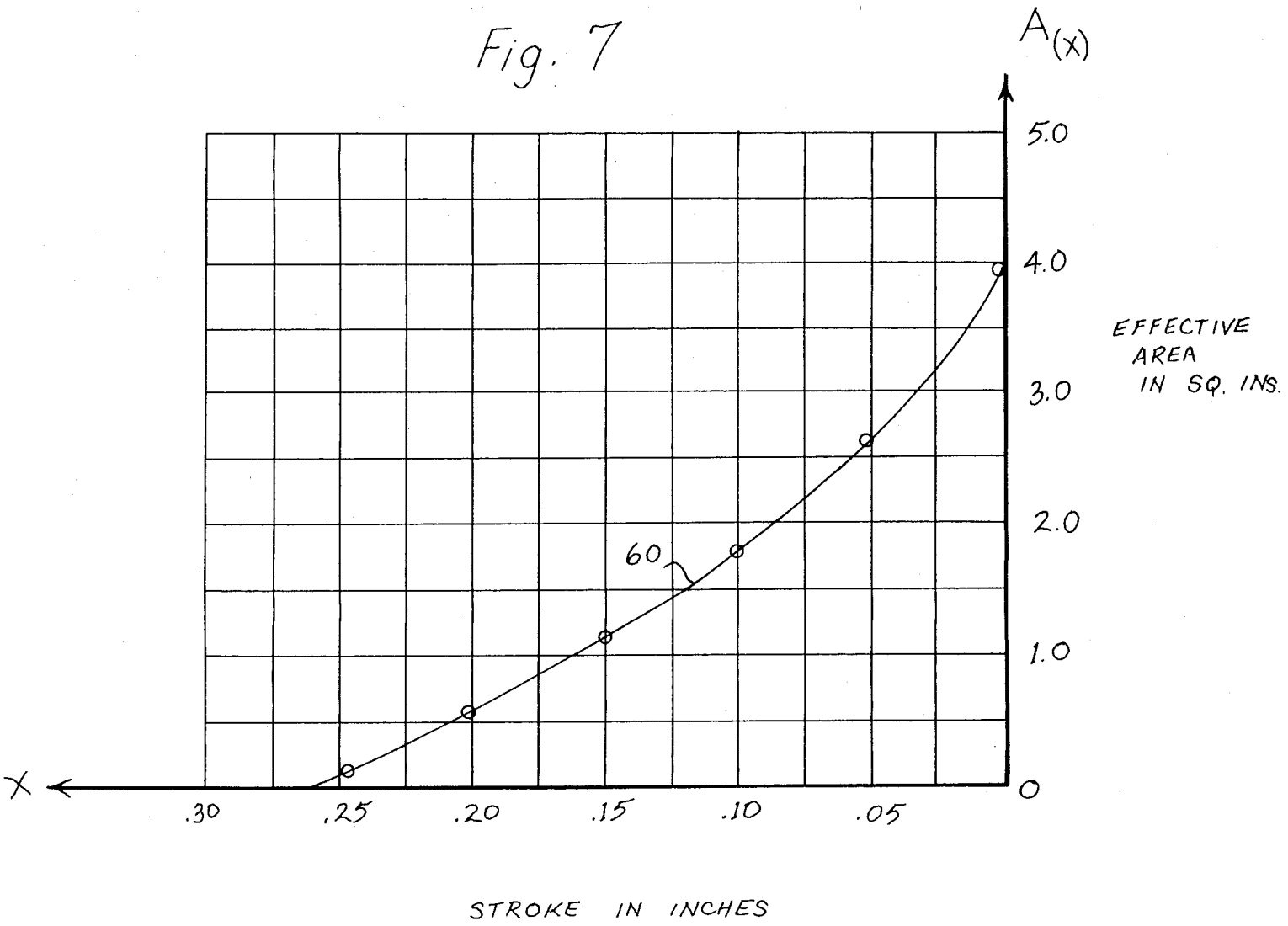
FIG. 7 is a performance curve plotted from data obtained by testing a tension actuator constructed as shown in FIGS. 4–6.

FIG. 7 is a plotted curve 60 of the data from Example II for showing the performance of this tension actuator 20A. The stroke values are plotted along the abcissa to the left of the origin "0", because the zero position is considered as being full extension, and the stroke is thus a contraction from the zero position.

In this actuator 20A the O.D. of the sections 42 onto which the tubular shell 24 is mounted is 0.500 of an inch. The thickness of this elastomeric shell is about 0.020 of an inch. Thus, the outside diameter D at the end fitting is 0.500+2x (0.020)=0.540 of an inch. The measured outside diameter of the inflated spherical position of the shell in FIG. 6A is 1.03 of an inch.

In FIG. 3 the theoretical diameter of the spherical shell upon full inflation is 2D, which in this example would be a value of 2×0.540=1.080 of an inch. Thus, it is seen that this actuator achieved ninety five percent of the theoretical maximum.

$$\frac{\text{Actual Inflated Diam.}}{\text{Theoretical Inflated Diam. of } 2D} = \frac{1.03}{1.08} = 95\%$$

In this actuator 20A the strands 26 were not bonded to the shell 24.

A number of interesting novel features of such a tension actuator are seen from a mathematical analysis thereof as follows:

$$F(x) = \text{Measured Gauge Pressure} \cdot A(x) \tag{5}$$

This equation repeats equation (2), namely, the force F(x) measured in pounds at any given axial contraction "x" in FIG. 7 is equal to a product of the gauge pressure of the internal fluid times the effective area at that contraction "x".

The total effective volumetric displacement V(x) at any given "x" is the area under the plotted curve 60 from the origin to that value of "x", as will be seen from the following analysis:

$$\text{Volume} = \text{length} \cdot \text{width} \cdot \text{depth} \tag{6}$$

$$\text{width} \cdot \text{depth} = \text{Effective Area} = A(x) \tag{7}$$

$$\therefore \text{Volumetric Displacement at any given "}x\text{"} = \tag{8}$$

$$V(x) = \int_0^x A(x)\,dx = \sum_0^x A(x)\,\Delta x$$

Therefore, the effective volumetric displacement can be calculated from the plot in FIG. 7.

By differentiating both sides of equation 8, it is now seen that:

$$dV(x) = A(x)dx = \frac{F(x)}{P(x)}\,dx \tag{9}$$

$$\therefore F(x)dx = P(x)\,dV(x) \tag{10}$$

$$\text{And, } F(x) = P(x)\frac{dV(x)}{dx} \tag{11}$$

In other words, at any given axial contraction position "x" with a generated force at that position being F(x) and the measured gauge pressure at that position being P(x), then an incremental axial contraction is proportional to a corresponding incremented change in displacement volume.

Conversely, as seen from equation (11), the greater the effective incremental change in volume produced by an incremental axial contraction, then the greater will be the force generated by supplying a given fluid pressure 34 (FIG. 3). Thus, this last equation (11) establishes a figure of merit for such tension actuators. In order to generate larger forces for a given applied fluid pressure 34, the desire is to achieve the greatest change in effective displacement for each given incremental contraction over the full range of operation.

The total effective volumetric displacement over the full stroke length is calculated by the total area under the curve to be 0.40 cubic inches.

Figure 8:
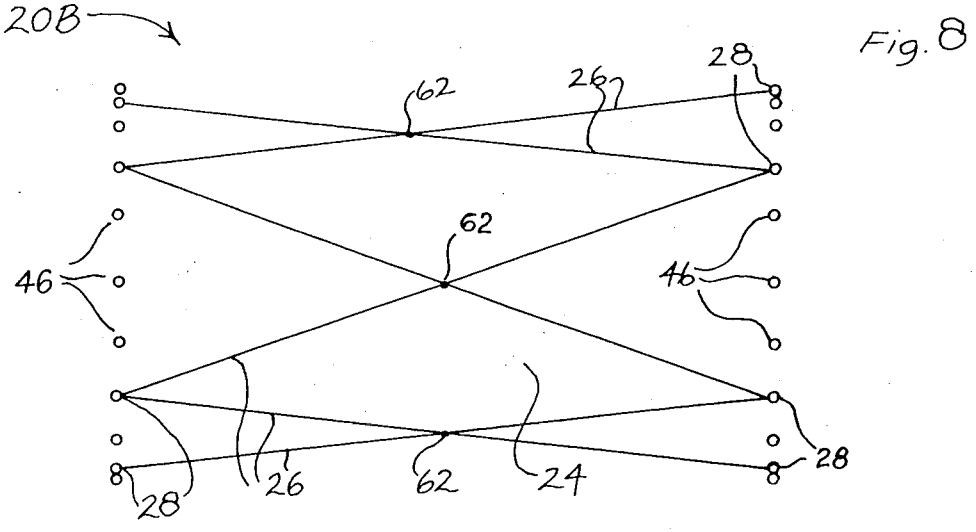
FIG. 8 is a diagrammatic side view illustrating another tension actuator embodying the invention and being shown in its axially elongated, deflated state. This actuator has five pairs of tension elements all lying at a pitch angle of 72°, with five of them oriented in a left-sense and the other five in a right-sense, and all of them defining a hyperboloid of revolution as a ruled surface. It is to be noted that these tension elements or strands have single crossing points located at their mid-length, thus advantageously stabilizing their positions on the elastomeric shell (which is omitted for clarity of illustration).
Figure 9:
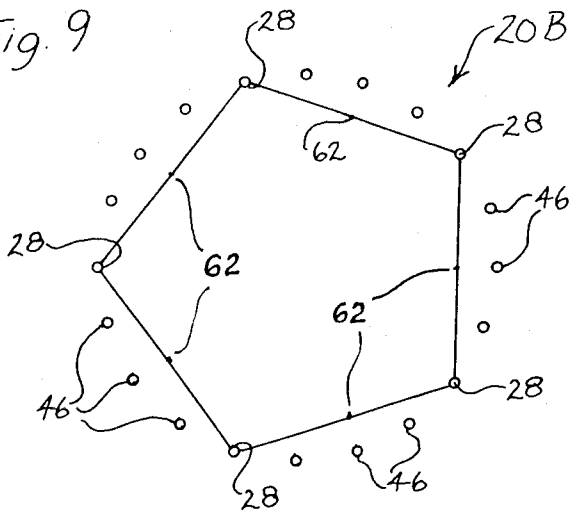
FIG. 9 is a diagrammatic end view of the actuator of FIG. 8.

In the actuator 20B shown in FIGS. 8 and 9 there are five pairs of the tension strands 26 oriented at a pitch angle of 72°. The double row of small circles 46 schematically indicate the keyhole-shaped slots 46 (FIG. 5) in the existing end fittings 22 which have already been described. Thus, as seen, in order to achieve a pitch angle of 72°, the continuous strand which is used to produce the five pairs of strands 26 is laced through every fourth one of the twenty slots 46. The anchoring points 28 are indicated.

It is noted that a single-crossing point 62 between each two neighboring struds and located exactly at the mid-length of the strands 26 is achieved when the number of pairs of strands is sufficiently small that $$\frac{360°}{\text{Pitch Angle}} = \text{Number of Pairs of Strands} \tag{12}$$

$$= \text{Number of Mid-Length crossing points.}$$

$$\frac{360°}{72°} = 5 \text{ Pairs of Strands} = 5 \text{ Mid-Length crossing points.} \tag{13}$$

The total number of crossing points 62 is five, but only three are seen in FIG. 8 because the other two are located on the other side of the elastomeric shell 24.

Figure 10:
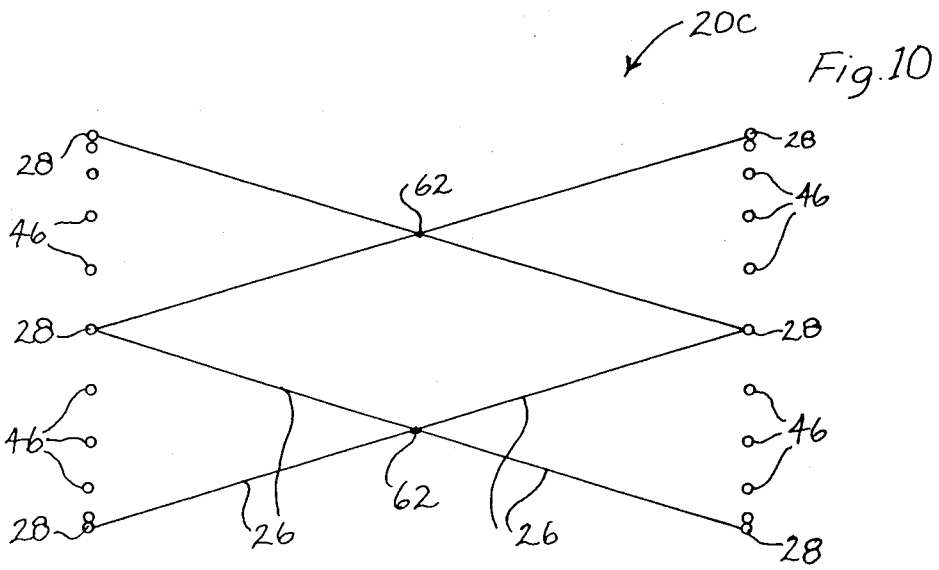
FIG. 10 is a diagrammatic side view illustrating a tension actuator generally similar to that shown in FIGS. 8 and 9, except that in FIG. 10 the actuator has four pairs of tension elements all lying at a pitch angle of 90°. Four of them are oriented in a left-sense and four are oriented in a right-sense. They define a hyperboloid of revolution as a ruled surface, and they have single-crossing points located at their mid-length, thus advantageously stabilizing their positions.
Figure 11:
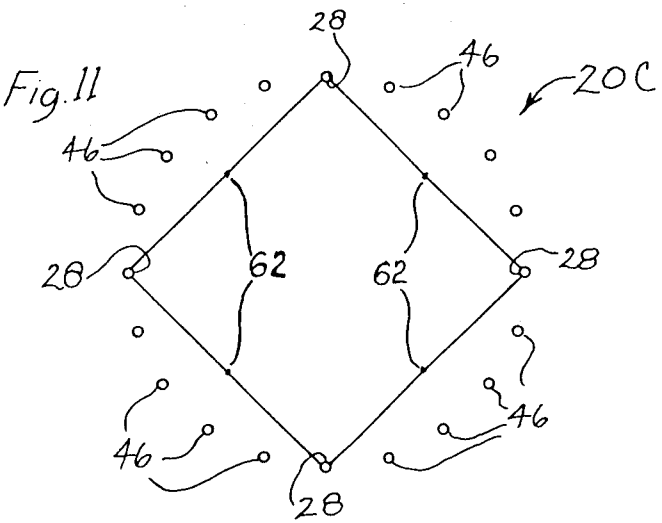
FIG. 11 is a diagrammatic end view of the actuator of FIG. 10.

In the actuator 20C, shown in FIGS. 10 and 11, there are four pairs of strands oriented at a pitch angle of 90°. This pitch angle is achieved by lacing through every fifth one of the twenty mounting slots 46 in the end fittings.

The total number of mid-length crossing points 62 in this actuator 20C is four.

The advantage of these single mid-length crossing points is that they stabilize the location of the strands 26 relative to the elastomeric shell 24. Moreover, by virtue of having relatively few of the strands in accordance with formula (12), the shell is able more freely to expand into the desired spherical shape 36 as desired for achieving the 2D theoretical maximum spherical diameter.

Figure 12:
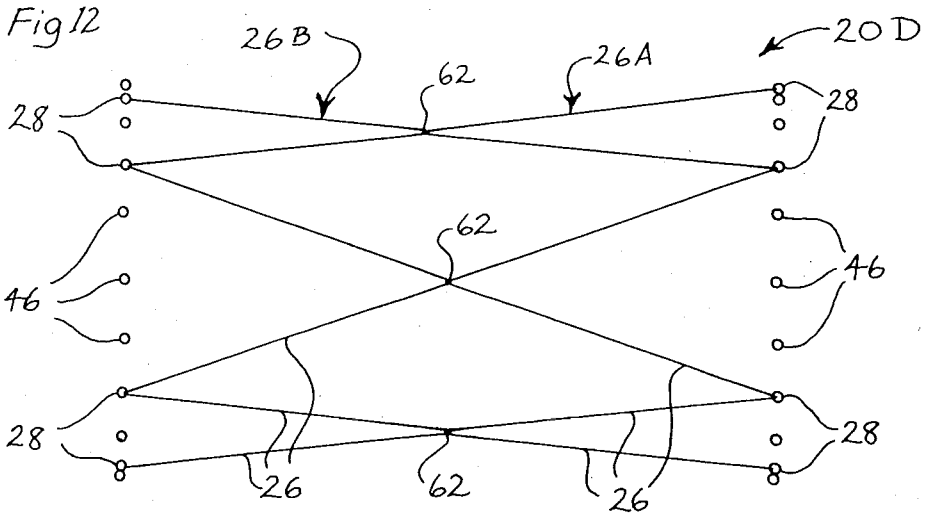
FIG. 12 shows an alternative arrangement of the five pairs of tension strands for obtaining the same pattern as the tension strands in FIGS. 8 and 9. The tension elements in FIG. 12 are arranged as isosceles triangles. At the vertex of pairs of such triangles, two of the strands are half-looped around each other providing a mid-length connection as a form of a mid-length crossing point.
Figure 13:
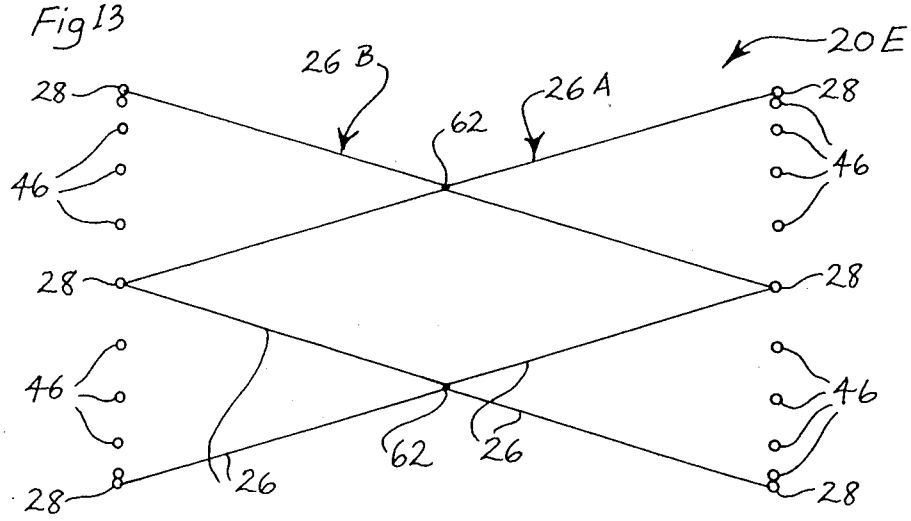
FIG. 13 shows an alternative arrangement of the four pairs of tension strands for obtaining the same pattern as in FIGS. 10 and 11.

As shown in FIGS. 12 and 13, respectively in the tension actuators 20D and 20E, two continuous strands 26A and 26B can be laced to form the five pairs and four pairs of strands 26, respectively. These two continuous strands 26A and B are half-looped, one around the other, at the mid-points 62 of the respective strands thus producing isosceles triangular patterns. The lacing assembly operation can be achieved faster when simultaneously using the two strands 26A and B as shown on FIGS. 12 and 13. Also, there is the advantage that somewhat more flexibility for expansion of the shell 24 is achieved by the half-loop mid-length crossings 62 which effectively form small hinges at the equator of the sphere 36 (FIG. 15).

Figure 14:
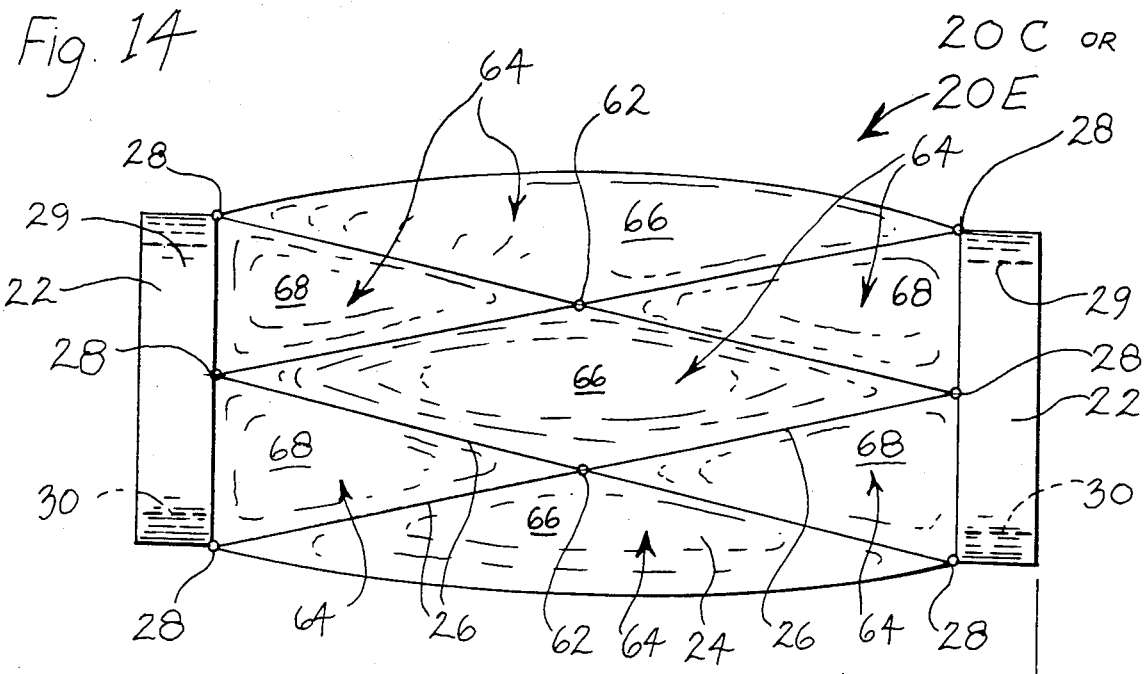
FIG. 14 is a side view of the tension actuator of FIG. 10 or 13, showing the reinforced elastomeric shell and the end fittings.
Figure 15:
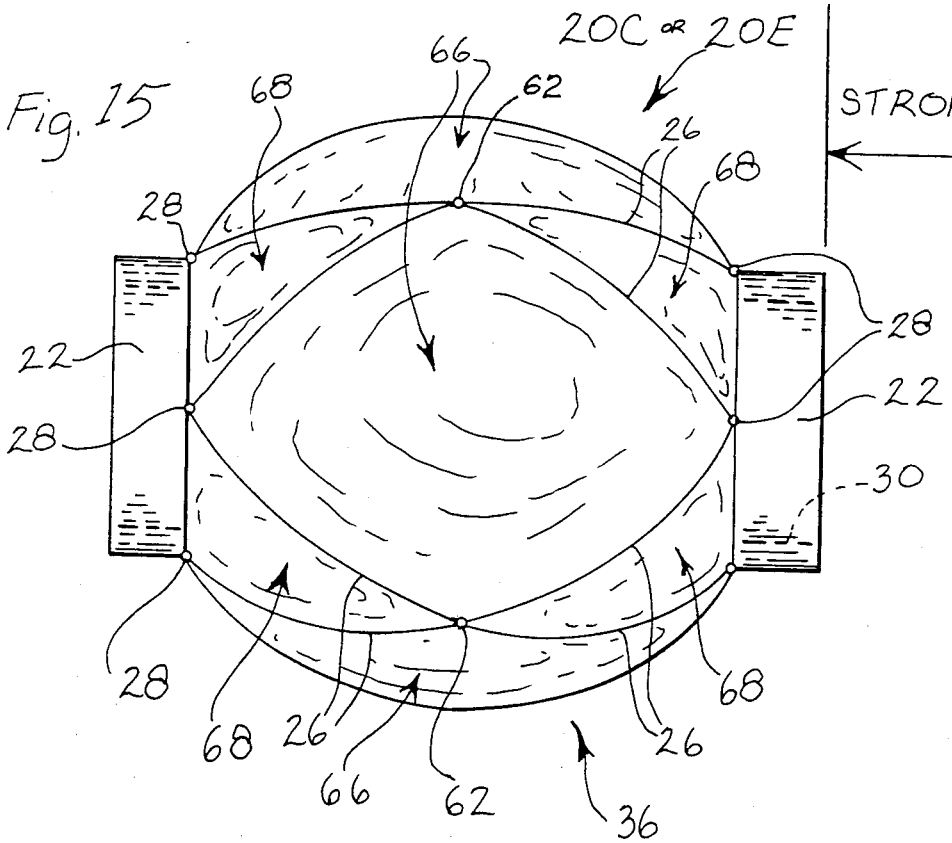
FIG. 15 shows the actuator of FIG: 14 fully inflated and axially contracted, indicating the stroke length.

FIGS. 14 and 15 show the actuator 20E of FIG. 13 or 20C of FIGS. 10 and 11 in axially extended and contracted positions, respectively, with its elastomeric shell illustrated as having domelike protrusions 64 in the lozenge-shaped (diamond-shaped) regions 66 between the strands 26 and in the isosceles-triangular-shaped regions 68 between these strands. The mid-length crossing points 62 may be formed as straight crossings 62 (FIGS. 10 and 11) or as half-loop crossings 62 (FIG. 13).

In all of the various tension actuator 20, 20A, 20B, 20C, 20D and 20E the elastomeric shell 24 itself is not reinforced when the actuator is intended for low pressure operations, i.e. at 15 p.s.i. gauge and below.

However, for high pressure operations up to 125 p.s.i. gauge or even higher then the elastomeric shell 24 is reinforced. This reinforcement may be provided in any one of several ways. For example, if the shell 24 is formed of polyurethene, then a molded grid-like square pattern of tiny straight ribs defining squares each having a side length in the range from 1/16th of an inch to ¼ of an inch is integrally molded with the shell 24 onto either its outer or inner tubular surface for reinforcing it while still providing the desired elastic stretchability of the thin shell. This square pattern is preferably oriented at a 45° angle for approximately aligning with the expanded lozenge-shaped regions 66 in FIG. 15.

Alternatively, the reinforcement may be a separately molded plastic grid of the same pattern size as for an integrally molded grid. This separately molded grid is fitted over the elastomeric shell 24 for reinforcing it, and this grid is located beneath the strands 26.

Alternatively, the reinforcement may be a knitted sleeve for example as described in the recently filed patent application Ser. No. 754,523; Filed: July 12th, 1985 in my name as inventor.

In summary, tension actuators embodying the present invention have a fast response, high frequency cyclic response capability with high efficiency and low-fatigue characteristics, and they are designable for either low or high pressure ranges of operation and they produce a relatively long and powerful stroke even at relatively small size as shown in FIGS. 4–7 and related data and analyses. It is to be understood that with larger D sizes, as defined herein, the effective forces generated will increase proportionately to $D^2$. Thus, relatively powerful axial thrusts can be generated by moderately sized actuators operating at "shop air" pressure ranges, namely, below about 125 p.s.i. gauge.

Since other changes and modifications varied to fit particular operating requirements and environments will become recognized by those skilled in the art for the various fluid-driven tension actuators the invention is not considered limited to the examples chosen for purposes of illustration, and includes all changes and modifications which do not constitute a departure from the true spirit and scope of this invention as claimed in the following claims and equivalents to the claimed elements.

What is claimed is:

1. A fluid-driven, tension actuator having an axis and being axially contractible upon inflation by fluid under pressure for converting fluid pressure energy into axial contraction displacement, comprising:

a pair of axially aligned and axially spaced ring-shaped end fittings adapted to move between maximum and minimum axial separation from each other, a tubular resilient, flexible, stretchable, elastomeric shell extending between said end fittings and being connected in air-tight relationship to both of said end fittings, a multiplicity of relatively inextensible, flexible strands extending between said and fittings and each being anchored to both of said end fittings, said strands being adjacent to the exterior surface of said tubular shell, a first plurality of said strands being extendible as straight lines and upon their extension as straight lines each being oriented at the same first pitch angle when the end fittings of the actuator are at their maximum axial separation from each other, a second plurality of said strands being extendible as straight lines and upon their extension as straight lines each being oriented at the same second pitch angle when the end fittings of the actuator are at said maximum axial separation from each other, said first and second pitch angles all having the same absolute value but said second pitch angles being of the opposite sense from said first pitch angles, the absolute value of said first and second pitch angles being in the range from 60° to 120°, said strands all being straight lines when the end fittings of the actuator are at their maximum axial separation from each other and each lying along a respective straight line generator element of an hyperboloid of revolution bounded at its opposite ends by said end fittings, at least one of said end fittings providing a passage therethrough communicating with the interior of said elastomeric shell for enabling said shell to be inflated and deflated, and said elastomeric shell upon full inflation with fluid under pressure stretching into a generally spherical surface of revolution with said strands each bowing convex outwardly away from the axis pulling said end fittings toward each other to their minimum axial separation for producing axial contraction of the actuator.

2. A fluid-driven tension actuator as claimed in claim 1, in which:

the outside diameter of said elastomeric shell immediately adjacent to said end fittings is "D", ans the outside diameter of said generally spherical surface upon said full inflation is about 2D.

3. A fluid-driven tension actuator as claimed in claim 2, in which:

the stroke of said actuator is about 0.37D.

4. A fluid-driven tension actuator as claimed in claim 1, in which:

the number of pairs of such strands of said first and second pluralities having said respective first and second pitch angles equals 360° divided by the absolute value of their pitch angle.

5. A fluid-driven tension actuator as claimed in claim 4, in which:

there are four pairs of such strands having said first and second pitch angles, and the absolute value of all of the pitch angles is 90°.

6. A fluid-driven tension actuator as claimed in claim 5, in which:

neighboring strands cross each other at mid-length crossing points, and there are a total of four such crossing points.

7. A fluid-driven tension actuator as claimed in claim 6, in which:

said crossing points each comprises half-loops of two of the strands about each other, said two strands each have an isosceles triangular configuration which is a mirror image of the other, and said half-loops are located at the vertex of the respective triangular configuration which are positioned tip-to-tip.

8. A fluid-driven tension actuator as claimed in claim 4, in which:

there are six pairs of such strands having said first and second pitch angles, and the absolute value of all of the pitch angles is 72°.

9. A fluid-driven tension actuator as claimed in claim 8, in which:

neighboring strands cross each other at mid-length crossing points, and there are a total of five such crossing points.

10. A fluid-driven tension actuator as claimed in claim 9, in which:

said crossing points each comprises half-loops of two of the strands about each other, said two strands each have an isosceles triangular configuration which is a mirror image of the other, and said half-loops are located at the vertex of the respective triangular configurations which are positioned tip-to-tip.

11. A fluid-driven tension actuator as claimed in claim 4, in which:

there are six pairs of such strands having said first and second pitch angles, and the absolute value of all of the pitch angles is 60°.

12. A fluid-driven tension actuator as claimed in claim 11, in which:

neighboring strands cross each other at mid-length crossing points, and there are a total of six such crossing points.

13. A fluid-driven tension actuator as claimed in claim 12, in which:

said crossing points each comprises half-loops of two of the strands about each other, said two strands each have an isoceles triangular configuration which is a mirror image of the other, and said half-loops are located at the vertex of the respective triangular configurations which are positioned tip-to-tip.

14. A fluid-driven tension actuator as claimed in claim 1, in which:

the axial distance "L" between the junction of the elastomeric shell and the respective end fittings in their maximum axial separation from each other is about equal to the outside diameter of the spherical surface of revolution of the actuator upon inflation.

15. A fluid-driven tension actuator as claimed in claim 1, in which:

said elastomeric shell has reinforcement by resiliently stretchable means having a grid-like pattern of small squares each having a side dimension in the range from 1/16 to ¼ of an inch.

16. A fluid-driven tension actuator as claimed in claim 15, in which:

said grid-like pattern of small squares comprises fine ribs molded integral with the tubular elastomeric shell.

17. A fluid-driven tension actuator as claimd in claim 1, in which:

the number of pairs of such strands having said first and second pitch angles is a multiple of 4.

18. A fluid-driven tension actuator as claimed in claim 1, in which:

the number of pairs of such strands having said first and second pitch angles is a multiple of 5.

19. A fluid-driven, tension actuator having an axis and being axially contractible upon inflation by fluid under pressure for converting fluid pressure energy into axial contraction displacement, comprising.

first and second ring-shaped end fittings each concentric with said axis and being axially aligned and being adapted to have maximum and minimum axial separation from each other, a tubular resilient, flexible, stretchable, elastomeric shell extending between said first and second end fittings and being connected in air-tight relationship to both of said end fittings for providing an air-tight chamber within said shell, a multiplicity of relatively inextensible, flexible strands extending between said first and second end fittings and each being anchored at anchoring points on said first and second end fittings, said strands being adjacent to the exterior surface of said tubular shell, a first plurality of said strands being extendible as straight lines upon said end fittings being positioned at their maximum axial separation from each other and each being oriented at the same first pitch angle upon their extension as straight lines, a second plurality of said strands being extendible as straight lines upon said end fittings being positioned at their maximum axial separation from each other and each being oriented at the same second pitch angle upon their extension as straight lines, said first and second pitch angles having the same absolute value but said second pitch angles being in the opposite direction from said first pitch angles, each of said strands of said first plurality upon extension as a straight line extending from a first anchoring point on said first end fitting to a second anchoring point on said second end fitting, said second anchoring point being angularly offset about said axis from said first anchoring point by an angle in the range from 60° to 120° inclusive of 60° and 120°, each of said strands of said second plurality upon extension as a straight line extending from a first anchoring point on said first end fitting to a second anchoring point on said second end fitting, said second anchoring point being angularly offset about said axis from said first anchoring point in the opposite direction from said strands of the first plurality by an angle in the range from 60° to 120° inclusive of 60° and 120°, said strands of said first and second pluralities upon their extension as straight lines each lying along a respective straight line generator element of an hyperboloid of revolution concentric with said axis and bounded at its opposite ends by said first and second end fittings, at least one of said end fitting providing a passage therethrough communicating with the interior of said chamber within said elastomeric shell for enabling said shell to be inflated and deflated, and said elastomeric shell upon inflation with fluid under pressure stretching into a generally spherical surface of revolution with said strands each bowing outwardly away from the axis pulling said end fittings toward each other to said minimum axial separation for producing axial contraction of the actuator.

* * * * *